US010856663B2

(12) United States Patent
Bowen

(10) Patent No.: US 10,856,663 B2
(45) Date of Patent: Dec. 8, 2020

(54) COVER FOR OUTDOOR FURNISHINGS

(71) Applicant: Jennifer Gifford Bowen, Owenton, KY (US)

(72) Inventor: Jennifer Gifford Bowen, Owenton, KY (US)

( * ) Notice: Subject to any disclaimer, the term of this patent is extended or adjusted under 35 U.S.C. 154(b) by 0 days.

(21) Appl. No.: 16/536,521

(22) Filed: Aug. 9, 2019

(65) Prior Publication Data

US 2020/0046130 A1 Feb. 13, 2020

Related U.S. Application Data

(60) Provisional application No. 62/718,000, filed on Aug. 13, 2018.

(51) Int. Cl.
*A47C 7/66* (2006.01)
*A47C 31/11* (2006.01)

(52) U.S. Cl.
CPC ..... *A47C 7/66* (2013.01); *A47C 31/113* (2013.01)

(58) Field of Classification Search
CPC ..... A47C 7/66; A47C 31/113
See application file for complete search history.

(56) References Cited

U.S. PATENT DOCUMENTS 3,115,953 A 12/1963 Peras
3,557,856 A * 1/1971 Berman ..... A63F 1/06 108/90 X
4,842,324 A 6/1989 Carden
4,910,855 A * 3/1990 Balarzs ..... B65B 69/0025 29/426.4
2010/0132595 A1* 6/2010 Gledhill ..... A47G 11/003 108/90

FOREIGN PATENT DOCUMENTS

DE 74 28 318 U 12/1974

OTHER PUBLICATIONS

PCT/US2019/046131 International Search Report and Written Opinion dated Oct. 31, 2019.

* cited by examiner

*Primary Examiner* — Anthony D Barfield
(74) *Attorney, Agent, or Firm* — Wood Herron & Evans LLP

(57) ABSTRACT

A semi-fitted outdoor furniture cover with interior topline flange and weighted hems. The flange is intended to lay between the cushion(s) and frame of the furniture item while the cover is deployed. The weight of the cushion(s) hold(s) the flange in position against the frame, allowing the flange to act as an internal anchor for the furniture cover. With the cover anchored in this manner, the user can draw aside only the front portion of the cover, use the furniture item while not needing to completely remove the rest of the cover, and easily return the front portion of the cover to its fully deployed position. While fully deployed, the weighted hems keep the cover in place and eliminate the need for other more complicated fittings. The result is continuous protection of the furniture item and ultimate ease-of use. The cover is made of weather-resistant fabric and has pleated corners with reinforced tabs.

8 Claims, 5 Drawing Sheets

COVER FOR OUTDOOR FURNISHINGS

PRIORITY CLAIM

Applicant claims the benefit of U.S. Provisional Application Ser. No. 62/718,000 filed on Aug. 13, 2018. Such application is incorporated herein by this specific reference as if fully set out herein.

TECHNICAL FIELD

This invention relates to covers useful in protecting outdoor furnishings from weather and other outdoor elements.

BACKGROUND

Furnishings used in outdoor areas are commonly left outside year-round. The furnishings are subject to a variety of weather conditions, including extreme heat, cold, rain, wind and snow, and other damaging elements, such as mold, mildew, dirt and debris. It is common to protect these furnishings with a cover to preserve their quality and longevity.

A variety of covers are available, from custom-fitted styles to unfitted tarpaulins. These covers are typically intended for off-season use, and therefore constructed primarily for long-term deployment. Many require fastening multiple hook-and-loop closures, zippers and/or ties. Placing them on furnishings can be time consuming and physically difficult. As a result, covers are typically placed onto the furnishing items in the Fall and removed in the Spring. The furnishings they cover go unused throughout the entire duration of the covers use.

But many parts of the country experience unseasonably pleasant days even during the late Fall, Winter, and early Spring months. On those days, a person may wish to use their outdoor furnishings, but is confronted with the difficulty of removing the off-season cover, and then later redeploying that cover. So, an opportunity to enjoy the outdoors and use their outdoor furnishings is missed, where the effort or aggravation of dealing with the cover may not be deemed worthy of a limited use of the furnishing.

Conversely, a person may risk leaving their outdoor furnishings uncovered in the early Fall and late Spring months, only to experience an unseasonably inclement day. As a result the furnishings may become damaged or dirtied by the elements, and therefore additional time or effort must be spent to prepare or clean the furnishings for use.

Accordingly, it has been one objective of the invention to provide an outdoor furniture cover that provides adequate protection but can also be easily removed (or partially removed) and readily (fully) redeployed to allow for periodic use of outdoor furnishings throughout all the months of the year.

It is another objective of this invention to provide an outdoor furniture cover that is easy to store and deploy.

It is also an objective of this invention to provide an outdoor furniture cover that provides adequate protection from the weather and other outdoor elements while deployed.

It is another objective of this invention to provide an outdoor furniture cover that can quickly and easily be fully or partially removed to allow for periodic use of the furnishing item.

And it is a further objective of this invention to provide an outdoor furniture cover that can be quickly and easily fully redeployed after such periodic use to allow continued protection of the furnishing item.

SUMMARY OF THE INVENTION

The present invention comprises a semi-fitted furniture cover made of weather-resistant fabric with weighted hems, pleated corners with reinforced tabs, and an interior topline flange. Rust-resistant snaps are optionally included between the flange and cover.

Semi-fitted construction allows for quicker and easier use, eliminates the need to purchase custom fitted furniture covers that are costlier and more difficult to deploy, and maximizes airflow to prevent mold and mildew growth.

Performance fabric is weather resistant and extends the life of the cover and the outdoor furnishings it protects.

Weighted hems keep the cover in place without the need for more complicated fittings.

Pleated corners create subtle shaping to allow for better overall drape and fit. Reinforced tabs sewn at the origination point of each pleat ensure longevity of the construction. Pleats in the fabric are inverted structures which inherently force the entire length of the pleated fabric to fold onto itself, and the weighted hem at the bottom of the pleat folds along with it. While the cover is fully deployed, this inherent folding together of the weighted hem creates (an) area(s) of increased heaviness, and further ensures the cover will remain fully deployed even in high wind situations.

The interior top-line flange is oriented for use between the frame of the furniture item and its cushion(s) and/or pillow(s). The weight of the cushion(s) holds the flange in position, and the flange acts as an internal anchor for the furniture cover. Anchored in this manner, the user can draw aside only the front portion of the cover, use the furniture item while not needing to completely remove the rest of the cover, and later fully recover the item, thereby offering continuous protection and ultimate ease of use.

The flange is connected to the cover by rust resistant snaps. These snaps help ensure the flange will not tear away from the cover with general use or with abuse by natural outdoor elements (as it may if the flange were connected by a stitched seam) but will instead simply detach from the cover. Detaching in this manner increases overall durability and longevity of the furniture cover. The snaps also allow the user to keep the flange in place, unsnap it from the rest of the cover, remove the rest of the cover entirely from the furniture item, use the furniture item, and then later easily redeploy the cover, and reattach it to the flange without need to reposition the flange between the cushion and furniture frame.

BRIEF DESCRIPTION OF THE DRAWINGS

These and other objectives and advantages will be readily apparent from the following written description and from the drawings in which.

Within FIG. 1, FIG. 2, FIG. 4, and FIG. 5, many numbered locations are also marked with the suffix "a" to indicate the present view of that site is on the topside of the invention, or with the suffix "b" to indicate the present view of that site is on the underside of the invention.

DETAILED DESCRIPTION OF THE INVENTION

Figure 1:
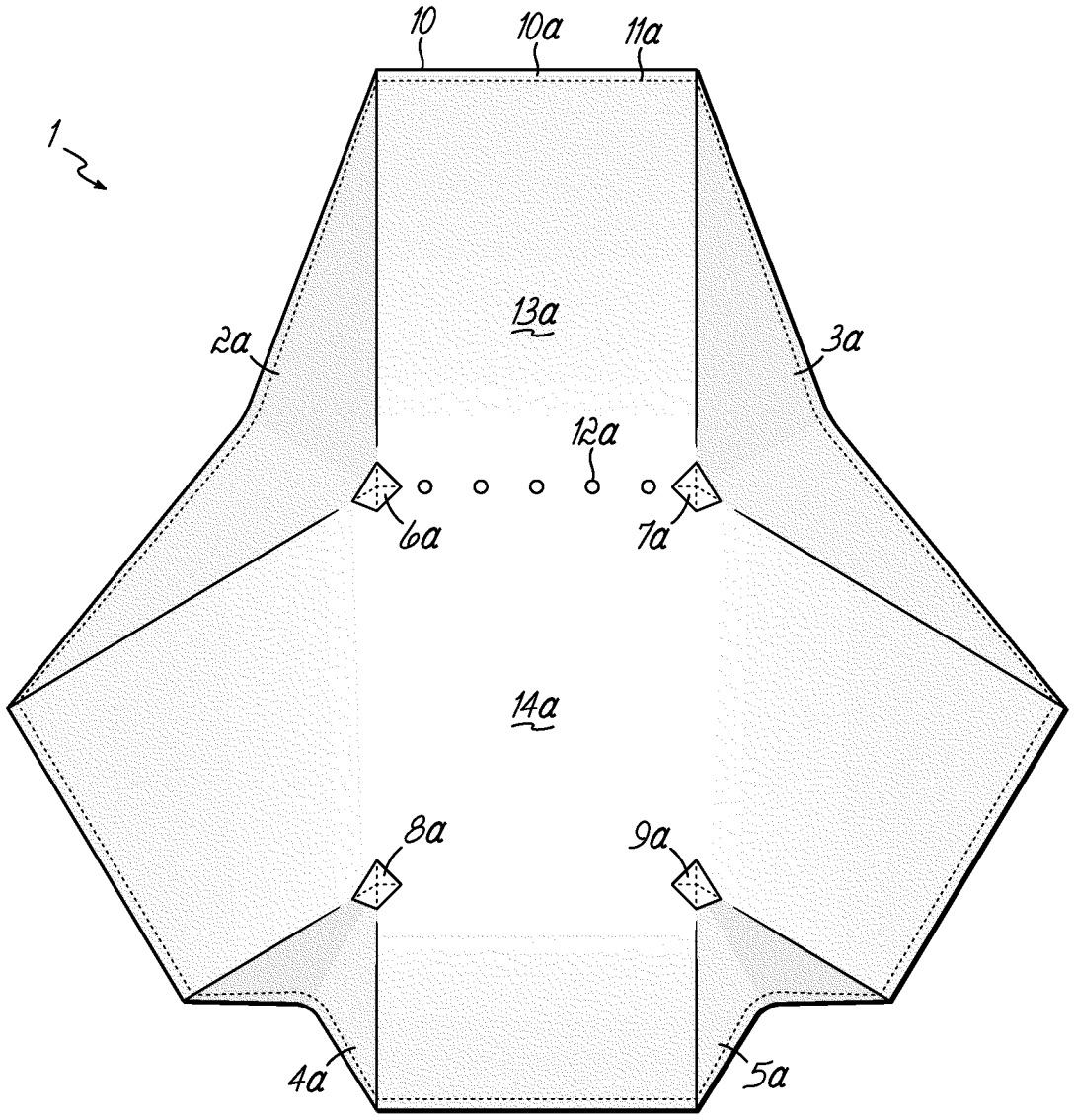
FIG. 1 is a plan view of the present invention laid out to show its topside configuration and construction.
Figure 2:
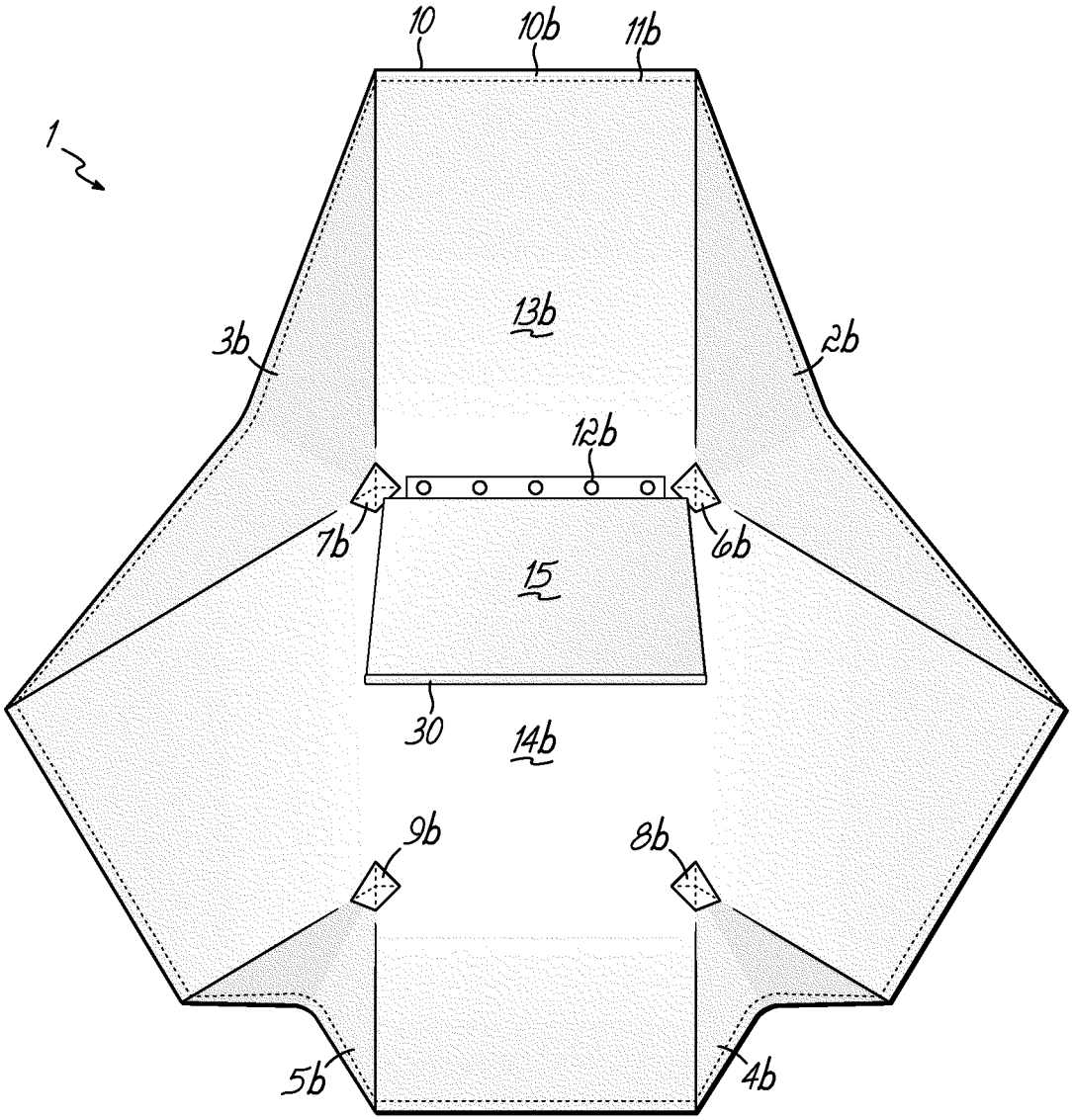
FIG. 2 is a plan view of the present invention from the opposite side of FIG. 1 laid out to show its underside configuration and construction.

One embodiment of the present invention comprises an outdoor furniture cover 1 as shown in plan view from the topside in FIG. 1 and as shown from the underside in FIG. 2. It is comprised of a suitable performance fabric, preferably waterproof and wear resistant, front panel 14*a*, 14*b*, rear panel 13*a*, 13*b*, weighted peripheral hem tape 10*a*, 10*b*, and rust resistant snaps 12*a*, 12*b*, or other similar material and fasteners to attach topline flange 15. The cover 1 is intended for deployment over an outdoor furniture item such as a chair 16 to protect that item from weather and other outside elements.

The invention utilizes generally available performance fabrics, or other similar material. The performance and/or weather resistant qualities of the fabric may include but are not limited to stain-resistance and easy cleanability; fade-resistance due to a higher UV rating; and a back-side coating that provides tear-, abrasion-, and water-resistance, and limits raveling when cut. The fabric may be of woven or non-woven quality and may be regular-width or wide-width goods.

The invention also utilizes generally available weighted hem tapes 10*a*, 10*b* or other similar material. Weighted hem tapes are traditionally used in window drapery construction and may be of various materials, widths, and weights. Such a weighted hem tape is sewn into hem pockets 10 at the finished edges of the cover 1. The hem pockets 10 are created by a stitch line 11*a*, 11*b* placed sufficient distance from the finished edge of the cover 1 to accommodate carrying the weighted hem tape within. The weighted hem tapes are intended to help the cover 1 remain fully deployed even in inclement weather. The weighted hem tapes are weather-resistant and of suitable width and weight to help maintain adequate coverage of the furnishings 16 even during windy conditions, and yet also be of tolerable lightless and flexibility to make deployment of the cover 1 as easy as possible.

In addition to the weighted hems 10, the invention also features pleated corners 2, 3, 4, 5 shown on respective sides by the suffix "a" or "b," to enhance the drape and fit of the cover 1.

When the cover 1 is used with a chair 16 as in this example, a first set of shorter corner pleats 4*a*, 5*a* are oriented adjacent front panel 14 (FIG. 1) while a second set of longer corner pleats 2*a*, 3*a* are oriented adjacent rear panel 13 (FIG. 1). When used with alterative outdoor furnishing items, such as a table, the corner pleats 2, 3, 4, 5 may be of the consistent or variable lengths.

The upper points at which the pleats originate are reinforced with self-fabric patches 6, 7, 8, 9 shown on respective sides by the suffixes "a" or "b", to ensure the pleat structure does not fail. The inverted structure of the pleats at corners 2, 3, 4, 5 inherently forces the entire length of the pleated fabric to fold onto itself, at the pleat and the weighted hem 10 at the bottom of the pleat corners 2, 3, 4, 5 folds along with it. While the cover 1 is fully deployed, this inherent folding-together of the weighted hem 10 creates (an) area(s) of increased heaviness, further ensuring the cover 1 will remain fully deployed even in high wind situations. Self-connecting fabric ties (not shown) can be positioned either on the top-side or under-side of the cover 1 at the pleat corner locations 2, 3, 4, 5 or other locations, and may also be incorporated to enhance the drape and fit of the cover 1.

The invention further utilizes generally available rust-resistant snaps 12, or other similar fasteners or material to removably attach the topline flange 15 to cover 1. As seen in FIG. 2, the snaps 12 join the top edge of the flange 15 to the cover 1 between pleat patches 6 & 7. These snaps 12 help ensure the flange 15 will not tear away from the cover 1 with general use or with abuse by natural outdoor elements (as it may if the flange 15 were connected by a stitched seam) but will instead simply easily detach from the cover 1. Detaching in this manner increases overall durability and longevity of the furniture cover 1. It will also be appreciated that the flange 15 has a free edge 30 unattached to cover 1 such that flange 15 is extended away from cover 1.

Figure 3:
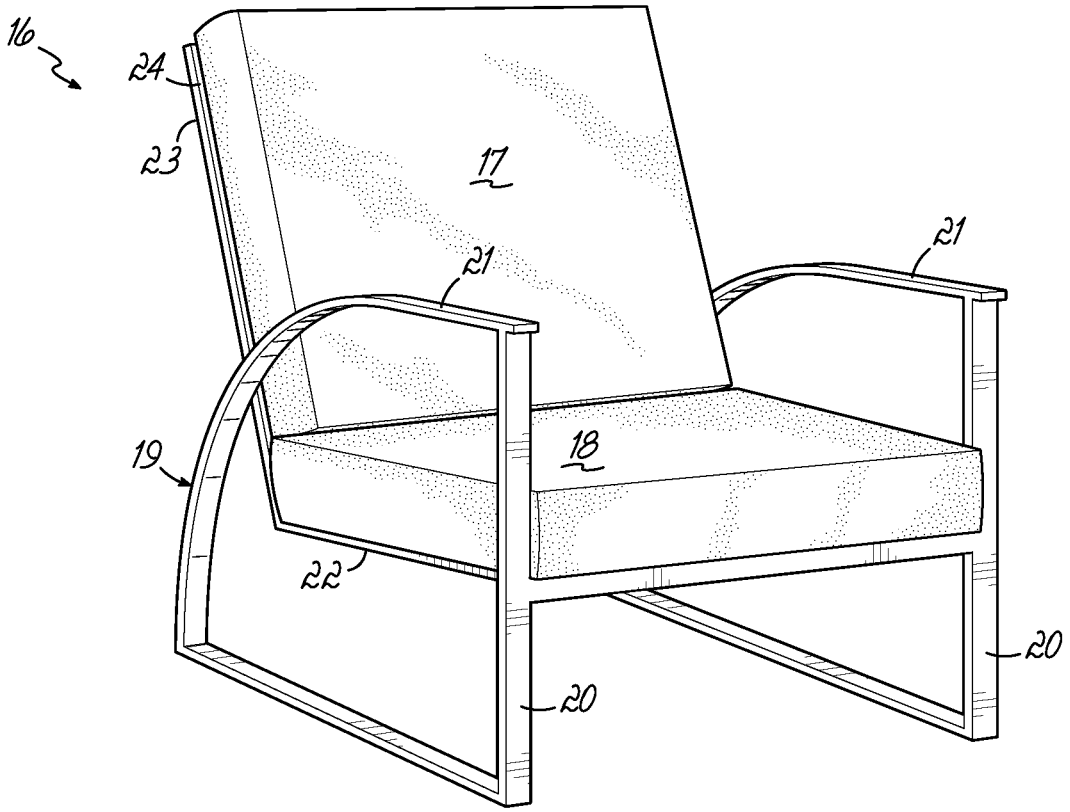
FIG. 3 is an isometric view of an exemplary outdoor furnishing item, such as a chair, on which a cover according to the invention can be used.

The cover 1 is intended for deployment over various styles and sizes of outdoor furnishings. Outdoor furnishings, for this example, a chair 16, as shown in FIG. 3, may be comprised of cushions, consisting of back cushion(s) 17 and seat cushion(s) 18; and a frame 19, consisting of legs 20, arms 21, seat-deck 22, and back 23. The back cushion(s) 17 may be a traditional box- or knife edge-style cushion(s) or loose pillow(s). The chair back 23 may be referred to in two parts: the inside back 24 which faces toward the cushions 17, 18 at the front of the chair 16, and an opposite outside back that faces behind.

Figure 4:
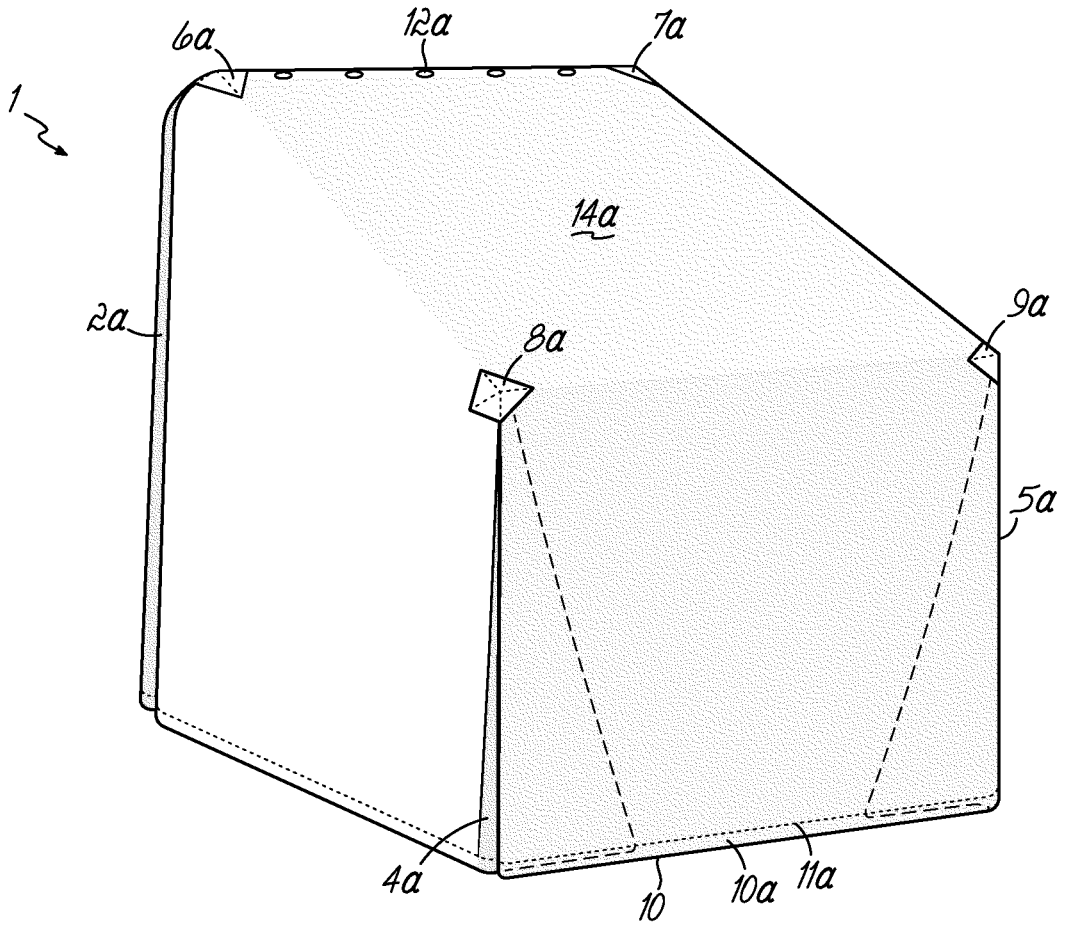
FIG. 4 is a view of the present invention deployed over an outdoor seating item, as seen from the outside.
Figure 5:
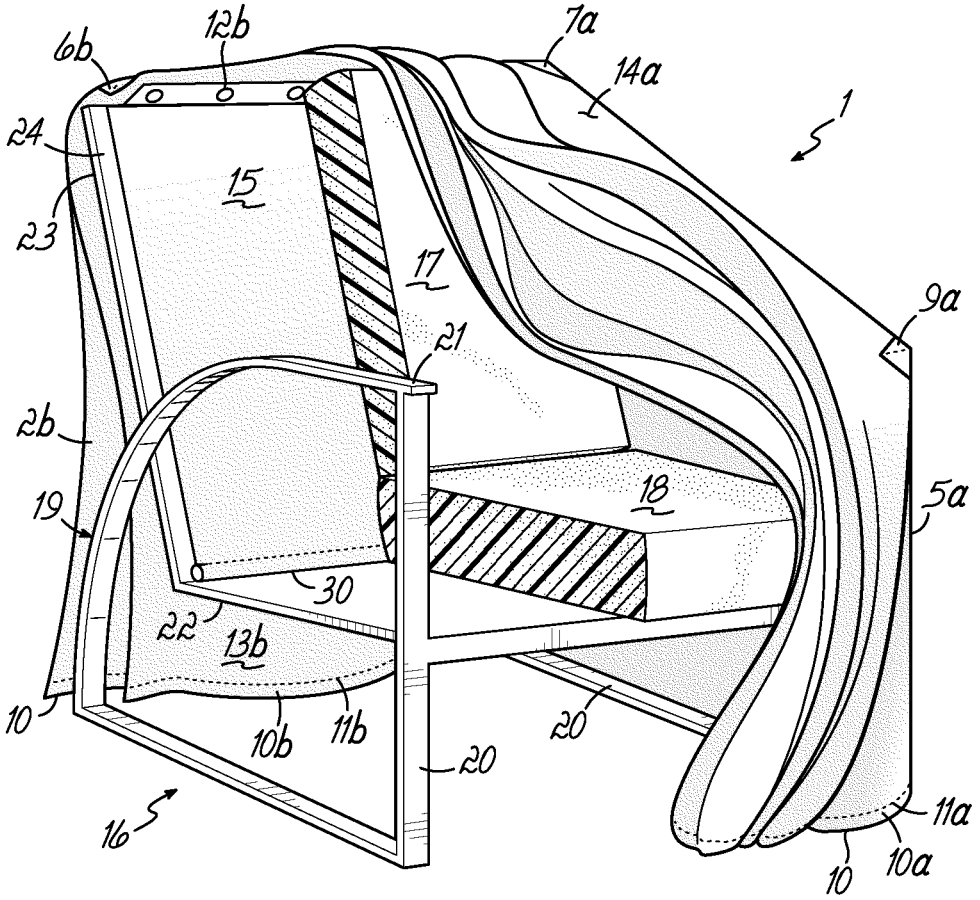
FIG. 5 is a view of one embodiment of the present invention deployed over a chair of FIG. 4 while also being partially removed (i.e. drawn-aside) to allow for use of the uncovered portion of the chair.

As shown in FIG. 4, the cover 1 is intended to fit loosely over a chair 16 or other such furnishing item. Pleat patches 6 & 7 are intended to be positioned generally near to the top left and right corners of the chair back 23 while pleat patches 8 & 9 are intended to be positioned generally near to the forwardmost point of the left and right chair arms 21. When positioned accordingly, the pleated corners 2, 3, 4, 5 drape and fold around the outermost corners of the furniture item. The weighted hem 10 will rest at or near to the ground. Simultaneously, the flange 15 is intended for placement between the inside back 24 of the chair 16 and the chair back or seat cushion(s) 17, 18 as shown in FIG. 5. If no back cushion(s) 17 is present, the flange 15 may also simply lay against the inside back 24 of the chair 16. This semi-fitted, loose style construction allows the user to quickly deploy the cover 1, easily remove a portion of the cover 1 for intermittent use of the chair 16 (FIG. 5), and swiftly redeploy the cover 1.

To initiate deployment of the cover 1, the user is advised to remove the seat cushions(s) 18 and back cushion(s) 17 from the furniture item, grasp the cover 1 at the interior self-fabric patches 6*b* & 7*b* while facing the inside front panel 14*b*, approach the outside back of the furniture item 16, lay the flange 15 along the inside back of the chair 24 and along the chair seat-deck 22, return the seat cushions(s) 18 and back cushion(s) 17 to their original locations, and then simply pull the rest of the cover 1 into place.

To use the chair 16 or other such furnishings while the cover 1 is deployed, the user is advised to grasp the cover 1 by the bottom edge of a front pleated corner 4 or 5, and to simply draw the front panel 14 back and to the side of the chair 16 as shown in FIG. 5. The flange 15 will act as a counterweight to keep the cover 1 in place. And while the user is sitting on the chair, the weight of their body on the back cushion(s) 17, seat cushions(s) 18, and flange 15 further secures the cover 1 in place. Additionally, the snaps 12 allow the user to keep the flange 15 in this position, unsnap it from the rest of the cover 1, remove the rest of the cover 1 entirely from the furniture item 16, use the furniture item 16, and then later easily redeploy the cover 1 over the furniture item 16, and reattach the flange 15 to the cover 1 without need to reposition the flange 15 between the cushion(s) 17, 18 and furniture frame 19. It will be appreciated that it is not necessary to detach the flange from the cover when the cover is drawn aside for use of chair 16. The flange may stay fully attached to the cover when the cover is drawn aside or alternatively may be partially detached from the cover.

To return the cover 1 to its fully deployed position, the user is advised to again grasp the cover 1 by the bottom edge of a front pleated corner 4 or 5 and to simply draw the front panel 14 back over the frame 19 of the chair 16 as shown in FIG. 4.

While one embodiment of the invention cover described herein is shown for use with a chair, the invention may be produced in various dimensions or shapes and be used with other furniture types.

And while the materials are described herein as performance fabrics, weighted hem tapes, and rust-resistant snaps, other materials that perform in a similar manner may be used.

Further, specific elements of the invention have been described herein for the purposes of illustration. However, it is to be understood that such specific elements may be modified. For example, it will be appreciated that while the drawings illustrate one embodiment of the invention, many alternate embodiments are contemplated. In this regard, the dimensions and structural relationships of the cover elements can be varied to provide a cover, within the scope of the invention, for a wide variety of furniture or other items which differ significantly from the furniture structure shown in the drawings. For example, the cover of the invention can easily be modified or adapted for use with elongated furniture such as couches, benches, sectional sofas, lounges, tables or the like, as well as other structures. Width, length and component relationships of the cover can be changed. These include but are not limited to the length and/or width of the corner pleats, top flange, hem and panels. And for round items, such as ottomans or the like, there would be no express "corners", but pleated sections can be positioned adequately around the items.

These and other modifications and advantages will become evident to those of skill in the art without departing from the spirit of the invention, and applicant intends to be bound only by the claims appended hereto.

What is claimed is:

1. A semi-fitted cover for a furniture piece having a back support, the cover comprising:

a cover having a top portion and a plurality of side panels;

a plurality of weighted hems extending about a periphery of the cover side panels;

a plurality of pleated sections between each side panel; and an elongated flange removably attached to an internal side of the cover where the top portion meets a side panel, the flange configured to extend away from the cover to a free edge and along the back support of the furniture piece.

2. A furniture cover of claim 1, wherein the top portion has corners and said pleated sections are oriented at the corners of the cover top portion.

3. A furniture cover as in claim 2 wherein, said pleated sections and said weighted hems bias the cover downwardly at said corners.

4. A furniture cover as in claim 1 wherein, said flange is partially releasable from said cover to permit said cover to be partially removed from the piece of furniture.

5. A furniture cover of claim 1 wherein said flange is selectively attached to said cover for partial detachment of the flange from the rest of the furniture cover.

6. A furniture cover as in claim 1 wherein, said top portion includes front and rear boundaries with side boundaries extending therebetween, a side panel extending from each boundary, and the plurality of pleated sections includes a front set of pleated sections and a rear set of pleated sections.

7. A furniture cover as in claim 6, wherein said side panel extending from the rear boundary is longer than the side panel extending from said front boundary and the front set of pleated sections is shorter than the rear pleated sections.

8. A furniture cover as in claim 1, wherein the flange is configured to extend between the back support of the furniture piece and a back cushion of the furniture piece.

* * * * *